US005678936A

United States Patent [19]

Hino

[11] Patent Number: 5,678,936

[45] Date of Patent: Oct. 21, 1997

[54] PRINTER WITH HEAD GAP ADJUSTING MECHANISM

[75] Inventor: Motohito Hino, Nagoya, Japan

[73] Assignee: Brother Kogyo Kabushiki Kaisha, Nagoya, Japan

[21] Appl. No.: 635,591

[22] Filed: Apr. 22, 1996

[30] Foreign Application Priority Data

Apr. 28, 1995 [JP] Japan ..... 7-129565

[51] Int. Cl.[6] ..... B41J 11/20

[52] U.S. Cl. ..... 400/55; 400/59

[58] Field of Search ..... 400/55, 59

[56] References Cited

U.S. PATENT DOCUMENTS 4,657,415 4/1987 Kikuchi et al. ..... 400/59
4,676,675 6/1987 Suzuki et al. .
4,738,552 4/1988 Kikuchi et al. ..... 400/55
5,131,765 7/1992 Bradley et al. ..... 400/55
5,156,464 10/1992 Sakai .

FOREIGN PATENT DOCUMENTS 6-115212 4/1994 Japan .

*Primary Examiner*—John S. Hilten
*Attorney, Agent, or Firm*—Oliff & Berridge

[57] ABSTRACT

A lever is rotatably mounted on a carriage on which a print head in a printer is mounted. The lever is integrally formed with an eccentric cam and a projection. Either a first position where a guide plate in the printer is sandwiched on its both surfaces by a first cam surface of the eccentric cam and the projection or a second position where the guide plate is sandwiched on its both surfaces by a second cam surface of the eccentric cam and the projection is selected by rotating the lever, thereby adjusting a head gap.

13 Claims, 10 Drawing Sheets

PRINTER WITH HEAD GAP ADJUSTING MECHANISM

BACKGROUND OF THE INVENTION

1. Field of the Invention

The invention relates to a printer capable of adjusting a spacing between a print head and a sheet of printing paper (which spacing will be hereinafter referred to as a "head gap"), and more particularly to a printer which can always maintain the head gap at a proper value by providing a height adjusting lever at a front portion of a carriage for mounting the print head thereon so that the lever can hold a guide plate on its upper and lower sides.

2. Description of Related Art

Unless a head gap between a print head and a sheet of printing paper in a printer is maintained at a proper value, the print resolution may be deteriorated or the print head may be damaged by friction against the printing paper. In some cases, a relatively thick sheet of paper, such as an envelope, rather than the relatively thin sheet of the usual printing paper is subjected to printing. Thus, the thickness of a printing medium is not fixed. Accordingly, if both the printing medium and the print head are fixed in the printer, the head gap varies with the thickness of the printing medium. It is therefore necessary for the printer to have the capability of adjusting the head gap according to the thickness of the printing medium to be used.

A prior art printer with a head gap adjusting mechanism is described in Japanese Unexamined Patent Publication No. 6-115212, for example. The head gap adjusting mechanism in the prior art printer described in this publication is partially shown in FIGS. 11A and 11B. FIGS. 11A and 11B are front views of a carriage 20 on which a print head (not shown) is mounted, in different operational positions. The portion of the head gap adjusting mechanism shown serves to adjust the height of the carriage 20 from a guide plate 21 provided below a front portion of the carriage 20 so as to extend along a moving direction of the carriage 20.

An adjusting lever 51, rotatable about the axis of a center shaft 4, is mounted on the front surface of the carriage 20. The adjusting lever 51 is integrally formed with an eccentric cam 52, an operation knob 53, a hook portion 54, and a stopper arm 55. The center shaft 4, eccentric relative to the eccentric cam 52, is mounted on a lower portion of the rear surface of the carriage 20. The eccentric cam 52 has cam surfaces 52A,52B,52C. The distance from the axis of the center shaft 4 to the cam surface 52A is shorter than the distance from the axis of the center shaft 4 to the cam surface 52B. The cam surfaces 52A,52B are continuous to each other as a curved surface. Either of the cam surfaces 52A,52B is adapted to come into contact with the guide plate 21 through operation of the operation knob 53.

A guide rail 34, forming an arc about the axis of the center shaft 4, and two stoppers 32,33, located inside the guide rail 34, are provided on the front surface of the carriage 20. The guide rail 34 serves to guide the hook portion 54 of the adjusting lever 51, and the stoppers 32,33 serve to stop a free end of the stopper arm 55 and thereby limit the rotation of the adjusting lever 51.

In the head gap adjusting mechanism of the printer shown in FIGS. 11A and 11B, when the operation knob 53 is operated to counterclockwise rotate the adjusting lever 51 to a position where the free end of the stopper arm 55 is stopped by the stopper 33 (see FIG. 11A), the cam surface 52A of the eccentric cam 52 contacts the guide plate 21.

Conversely, when the operation knob 53 is operated to clockwise rotate the adjusting lever 51 to a position where the free end of the stopper arm 55 is stopped by the stopper 32 (see FIG. 11B), the cam surface 52B of the eccentric cam 52 contacts the guide plate 21. In these two positions, the front portion of the carriage 20 is at different levels from the guide plate 21. Accordingly, selection between these conditions causes rotation of the carriage 20 about a guide shaft (not shown) provided at a rear lower portion of the carriage 20. As a result, the print head is displaced to thereby adjust the head gap.

However, the conventional head gap adjusting mechanism of the printer mentioned above has the following problems. In this head gap adjusting mechanism, the print head is positioned by moving either the cam surface 52A or 52B of the eccentric cam 52 into contact with the upper surface of the guide plate 21. This contact depends merely, on the weight of the carriage 20 and the members mounted thereon. Accordingly, if a force is applied in a direction that lifts the front portion of the carriage 20, the eccentric cam 52 may disengage from the guide plate 21, causing a variation in the head gap.

Such a force may be applied by the following causes. While the carriage 20 is usually driven by a belt, the mount position of the belt on the carriage 20 is different from the center of gravity of the whole of the carriage 20 with the members mounted thereon. Therefore, movement of the carriage 20 along the guide shaft in printing causes a moment of force. In a printer capable of printing at high speeds and, accordingly, exhibiting quick acceleration and deceleration of the carriage 20, this moment brings about a condition equivalent to that where the carriage 20 is moving as staggering during printing. As a result, there readily occurs a deterioration in print resolution or a frictional damage to the print head due to a variation in the head gap.

Another problem is associated with capping for the print head. That is, in the case that the print head is of an ink jet type, it is necessary to suck, or remove, ink deteriorated by a viscosity increase or bubbles in the print head and thereby restore the normal operational condition of the print head. Accordingly, the carriage 20 is moved away from a printing range to a predetermined restoring position at a suitable frequency, so as to make the print head face a restoring device. At this restoring position, a purge cap of the restoring device is moved to cover the print head, thereby performing a head restoring operation. In the case where the print head is mounted on the lower surface of the carriage 20, such a capping operation is performed from the lower side of the print head. As a result, an upward force is applied to the carriage 20. If this upward force is strong, the eccentric cam 52 may disengage from the guide plate 21, and the capping for the print head may not be reliably performed. If the capping for the print head is not reliably performed, outside air enters the restoring device from a space between the print head and the purge cap, so that the head restoring operation cannot be properly performed. If the head restoring operation is not properly performed, the quality of print output after the head restoring operation is lowered.

In a particular type of printer such that a printing operation is restored after the head restoring operation is properly performed, the following problem may occur. That is, if the print head is not properly capped, the head restoring operation is repeated until it is properly performed. As a result, the time required for the head restoring operation becomes long thereby causing a reduction in the overall printing speed.

To prevent such phenomena, it is necessary to take measures such that a restriction plate for pressing down the cam surface 52C of the eccentric cam 52 is provided in parallel to the guide plate 21. However, if the accuracy of working or mounting the restriction plate is low, there occurs another problem such that the parallelism between the restriction plate and the guide plate 21 is difficult to obtain, or the mounting of the carriage 20 is difficult. Another means for preventing the disengagement of the eccentric cam 52 uses a biasing means, such as a spring, has been proposed. However, a cost increase due to an increase in number of parts unavoidably results.

SUMMARY OF THE INVENTION

An object of the invention is to provide a printer with a head gap adjusting mechanism which can prevent the disengagement of the carriage from the guide plate during movement of the carriage, and has a reduced number of parts in that it excludes an additional restricting means and/or biasing means, to thereby eliminate a deterioration in the print resolution and frictional damage to the print head due to a variation in the head gap.

According to the invention, achieving the above object, there is provided a printer with a head gap adjusting mechanism, comprising a carriage adapted to move along a print area; a print head mounted on the carriage; a guide shaft for guiding one end of the carriage; a guide plate for guiding the other end of the carriage; and a lever rotatably mounted on the carriage, wherein the lever is integrally formed with a first upper contact portion and a second upper contact portion adapted to selectively come into contact with an upper surface of the guide plate by rotation of the lever; the lever is integrally formed with a first lower contact portion adapted to come into contact with a lower surface of the guide plate when the first upper contact portion comes into contact with the upper surface of the guide plate; and the lever is also integrally formed with a second lower contact portion adapted to come into contact with the lower surface of the guide plate when the second upper contact portion comes into contact with the upper surface of the guide plate; a distance from the center of rotation of the lever to the first upper contact portion being different from a distance from the center of rotation of the lever to the second upper contact portion.

In the printer with the head gap adjusting mechanism according to the invention having the above structure, when the lever is rotated, a selection is made between a first position where the guide plate is sandwiched by the first upper contact portion and the first lower contact portion, which are integral with the lever, and a second position where the guide plate is sandwiched by the second upper contact portion and the second lower contact portion which are integral with the lever. Accordingly, the distance from the guide plate to the center of rotation of the lever is changed. As a result, the carriage is rotated about the guide shaft to change a head gap defined between the print head and a printing surface. In this manner, by rotationally operating the lever according to the thickness of a printing medium, the head gap can be properly adjusted and maintained during printing. Furthermore, the lever holds the guide plate on its both surfaces in both lever positions. Therefore, there is no possibility that the carriage may be rotated to vary the head gap during movement of the carriage along the print area.

As described above, according to the printer with the head gap adjusting mechanism of the invention, in both lever positions obtained by rotationally operating the lever to adjust the head gap, the guide plate is sandwiched by the first upper contact portion and the first lower contact portion of the lever or by the second upper contact portion and the second lower contact portion of the lever. Accordingly, the disengagement of the carriage from the guide plate during movement of the carriage along the print area can be prevented without the use of any additional restricting means and/or biasing means, thereby eliminating a deterioration in the print resolution and frictional damage to the print head due to a variation in the head gap. Further, since each of the first upper contact portion, the second upper contact portion, the first lower contact portion, and the second lower contact portion are integral with the lever, the number of parts can be reduced and the lever can be easily mounted to the carriage.

BRIEF DESCRIPTION OF THE DRAWINGS

Preferred embodiments of the invention will be described in detail with reference to the following figures wherein.

DETAILED DESCRIPTION OF THE PREFERRED EMBODIMENTS

There will now be described the preferred embodiments of the invention with reference to the drawings.

Figure 1:
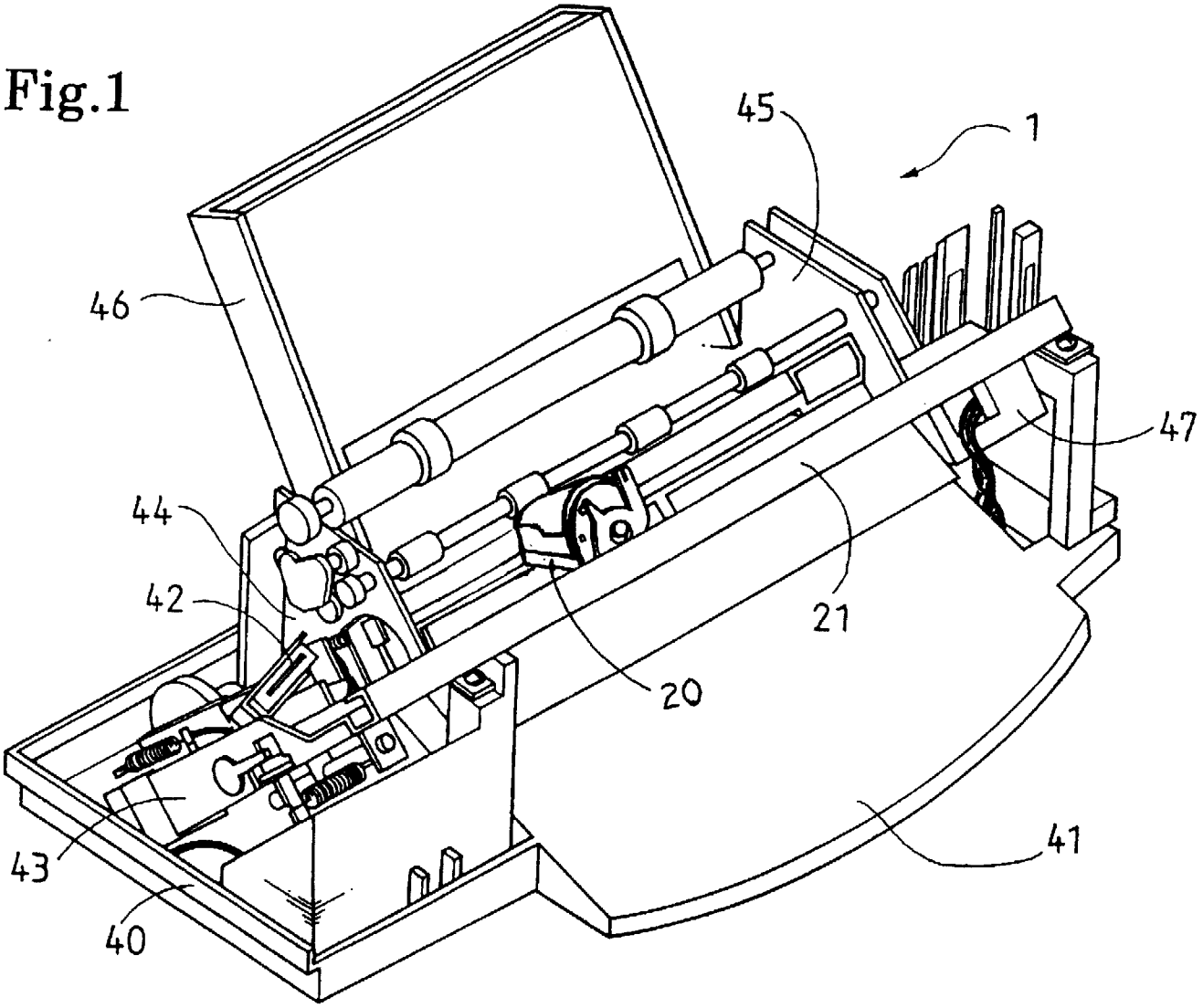
FIG. 1 is a perspective view of the whole of a printer with a head gap adjusting mechanism according to a first preferred embodiment.

Referring to FIG. 1, which shows a perspective view of a printer 1 with a head gap adjusting mechanism according to the first preferred embodiment of the invention, the printer 1 is provided with an under frame 40. The under frame 40 is provided at its front portion with a manual paper feeding portion 41. A subframe 43 is mounted on an upper portion of the under frame 40 at a position behind the manual paper feeding portion 41. A carriage 20, to be hereinafter described, and a purge cap 42 are mounted on the subframe 43. A paper feed cassette 46 capable of storing a plurality of sheets of printing paper is detachably mounted on an upper rear portion of the subframe 43.

The subframe 43 is provided with right and left side frames 44 and 45. The paper feed cassette 46 is mounted between the right and left side frames 44,45. The purge cap 42 is located outside the left side frame 44. A guide plate 21 for guiding the carriage 20 is formed at a front end portion of the subframe 43. The carriage 20 is movable along a printing area and the movable range of the carriage 20 also includes a position where the carriage 20 faces the purge cap 42. The carriage 20 is a member for mounting a print head to be hereinafter described, and the purge cap 42 is a part of a purge device for restoring the print head. Further, a CR motor 47 as a drive source for moving the carriage 20 along the guide plate 21 is mounted on the lower surface of the subframe 43.

The carriage 20 will now be described in more detail with reference to FIG. 2. A print head 22 of an ink jet type is mounted on the carriage 20. The print head 22 is adapted to be moved with the carriage 20 along a printing area in such a manner as to face a sheet of printing sheet S fed by a platen roller 23. The carriage 20 is adapted to be belt-driven by the CR motor 47. An end portion of the carriage 20 on the platen roller 23 side (this side will be hereinafter referred to as a rear side) is guided by a guide shaft 24, and another end portion of the carriage 20, on the manual paper feeding portion 41 side (see FIG. 1) (this side will be hereinafter referred to as a front side), is guided by the guide plate 21 through a lever 2. The guide shaft 24 extends in parallel to the platen roller 23, and is supported at opposite ends to the side frames 44,45 shown in FIG. 1. The print head 22 and an ink cartridge 26 are mounted on the carriage 20 through a head holder 25.

An eject roller 28 and a pinch roller 29, for ejecting the printing sheet S having just passed a print position opposed to an ink emerging surface 27 of the print head 22 are provided above the platen roller 23 to prevent slack in the printing paper S at the print position. If the printing sheet S is slack at the print position, a head gap G, defined as the distance between the ink emerging surface 27 of the print head 22 and the printing paper S, changes causing a deterioration in the print resolution or damage to the ink emerging surface 27 due to friction with the printing paper S. Thus, the eject roller 28 and the pinch roller 29 are located above the print position so as to avoid the above problem. Further, a paper guide 30 is provided on the back side of the printing paper S as viewed from the print head 22.

Figure 4:
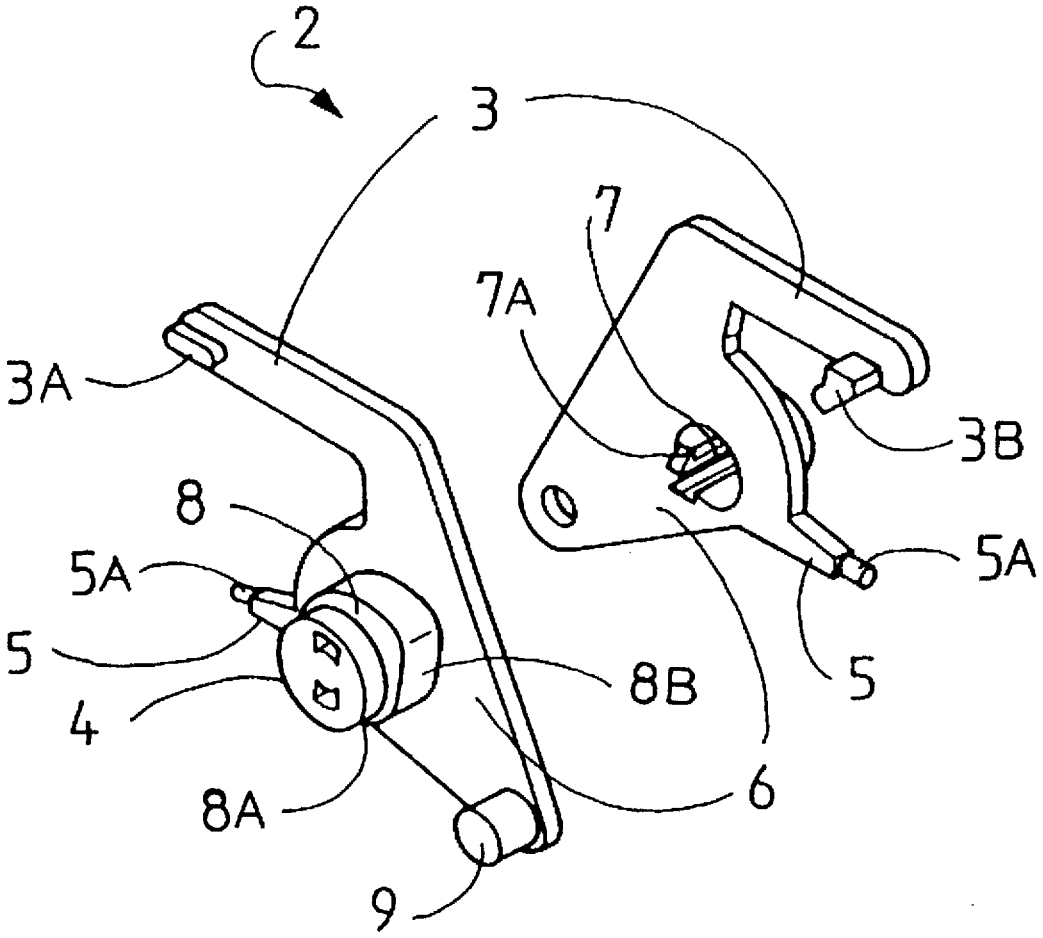
FIG. 4 is a perspective view of a lever according to the first preferred embodiment.

The lever 2, mounted at the front end portion of the carriage 20 on the guide plate 21 side, will now be described with reference to FIG. 4. FIG. 4 shows the lever 2 in perspective as viewed from both the front and back sides. The lever 2 is an integral member formed of a material having a low coefficient of friction, such as a synthetic resin, to have an operation arm 3, a shaft portion 4, a stopper arm 5, and a holding portion 6.

The operation arm 3 is an operating portion adapted to be rotationally operated by an operator about the axis of the shaft portion 4 when the lever 2 is mounted on the carriage 20. A knob 3A, adapted to be handled by the fingers of the operator, is formed at a free end portion of the operation arm 3 on its front side and a hook 3B, adapted to be guided by a guide rail of the carriage 20, to be hereinafter described, is formed at the free end portion of the operation arm 3 on its back side. The shaft portion 4 is a rotational center portion of the lever 2 when the lever 2 is mounted on the carriage 20. A pair of hooks 7, adapted to be engaged with a bearing portion of the carriage 20, to be hereinafter described, are so formed as to project from the back side of the shaft portion 4. Each hook 7 has a free end portion formed with a small projection 7A. Further, an eccentric cam 8 is formed around the shaft portion 4 on its front side. The eccentric cam 8 has a side surface formed with cam surfaces 8A,8B. A distance from the axis of the shaft portion 4 to the cam surface 8B is larger than that from the axis of the shaft portion 4 to the cam surface 8A.

The stopper arm 5 serves to limit the rotational range of the lever 2. A free end 5A of the stopper arm 5 is adapted to be stopped by stoppers of the carriage 20 to be hereinafter described. The holding portion 6 is formed with a projection 9. The projection 9 and the eccentric cam 8 cooperate with each other so that they sandwich the guide plate 21 on its both surfaces in the condition where the lever 2 is mounted on the carriage 20 and set in the printer 1.

Figure 5:
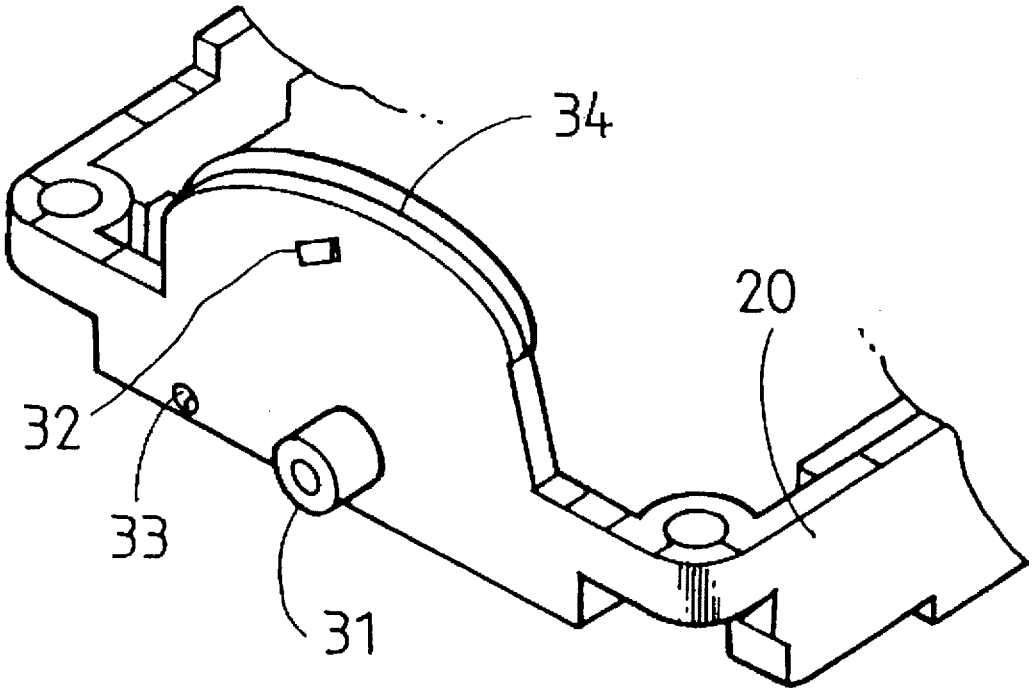
FIG. 5 is a perspective view of a lever mounting portion of a carriage.

A front portion of the carriage 20, on which the lever 2 is mounted, will now be described with reference to FIG. 5. The front portion of the carriage 20 is formed with a cylindrical bearing portion 31 for bearing the shaft portion 4 of the lever 2, two projecting stoppers 32 and 33 for stopping the free end 5A of the stopper arm 5 to limit the rotational range of the lever 2, and an arcuate guide rail 34 for guiding the hook 3B of the operation arm 3.

The inside diameter of the bearing portion 31 is set equal to the outside total width of the pair of hooks 7 of the lever 2 (i.e., the distance between the outer surfaces of the hooks 7, except for the small projections 7A). In mounting the shaft portion 4 of the lever 2 to the bearing portion 31 of the carriage 20, the hooks 7 of the shaft portion 4 of the lever 2 are inserted into the bearing portion 31. During insertion of the hooks 7 into the bearing portion 31, the hooks 7 are elastically deformed diametrically inward of the bearing portion 31 by an amount corresponding to the small projections 7A. When the small projections 7A come out of the bearing portion 31, the hooks 7 are elastically restored their original condition. Thus, the lever 2 is mounted on the carriage 20 in such a manner as to be manually rotatable and be prevented from being disengaged from the bearing portion 31. Further, each of the stoppers 32,33 has such a height that when the operation arm 3 is operated by the operator to rotate the lever 2, the free end 5A of the stopper arm comes into contact with a one of the stoppers 32,33, and when the lever 2 is further rotated, the stopper arm 5 is elastically deformed to allow the free end 5A to pass over the contacted stopper 32,33.

Figure 2:
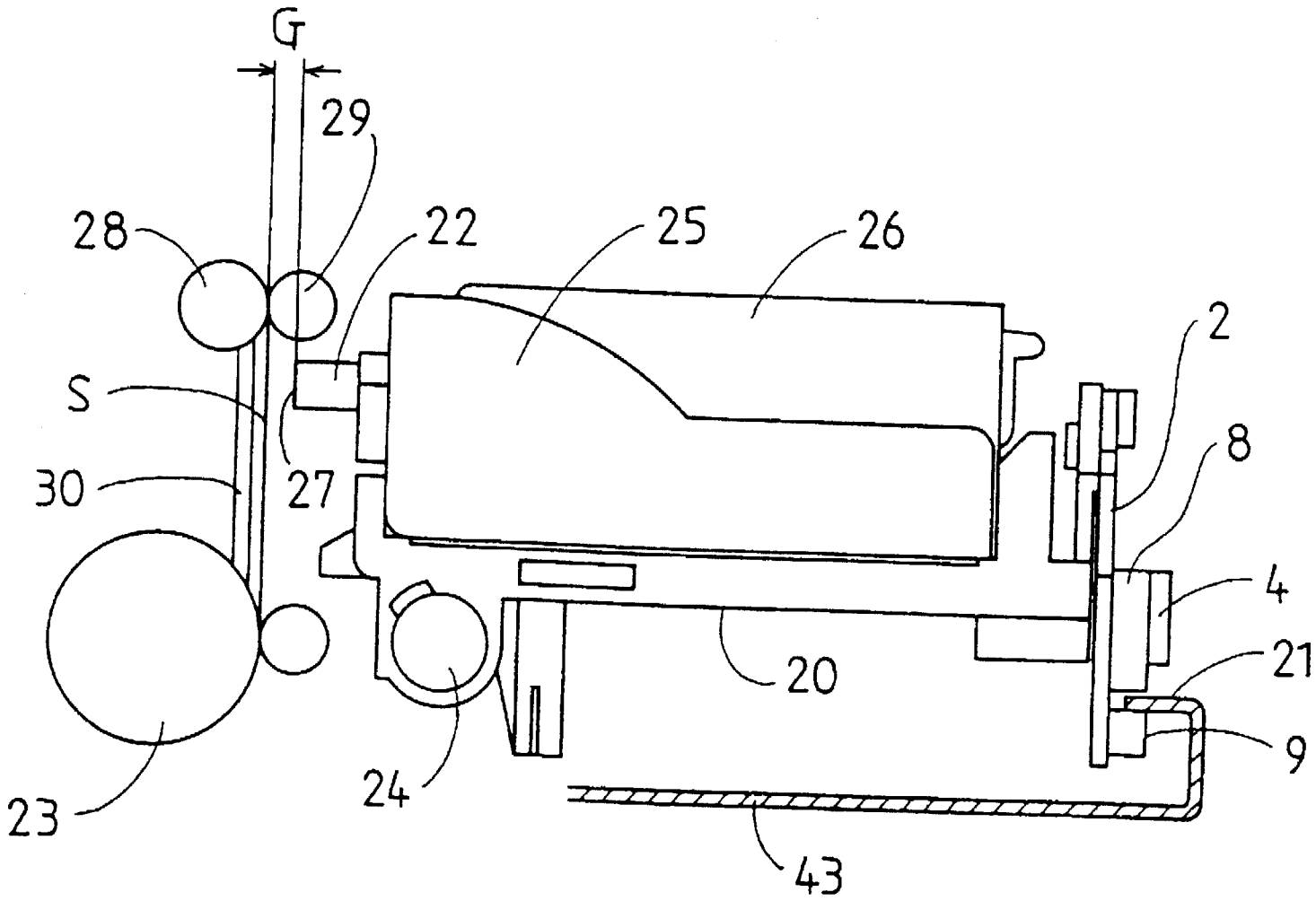
FIG. 2 is a side view showing a condition where the head gap adjusting mechanism in the printer has a first position corresponding to a thin sheet of printing paper.

In the condition where the lever 2 is mounted on the carriage 20 and set in the printer 1 as shown in FIG. 2, the eccentric cam 8 and the projection 9 are in contact with the upper and lower surfaces of the guide plate 21 to determine the height of the front end portion of the carriage 20 from the guide plate 21. Accordingly, the carriage 20 is inhibited from rotating about the guide shaft 24, thereby maintaining the head gap G at a constant value. As a result, by moving the carriage 20 along a printing area while ejecting ink from the print head 22 according to the print data, the printing can be performed on the printing paper S supplied from the paper feed cassette 46 by the platen roller 23.

The operation of the head gap adjusting mechanism will now be described. As the lever 2 is rotatable about the axis of the shaft portion 4 as mentioned above, the rotation of the lever 2 allows selection of either of the positions where the guide plate 21 is sandwiched by the cam surface 8A of the eccentric cam 8 and the projection 9 or where the guide plate 21 is sandwiched by the cam surface 8B of the eccentric cam 8 and the projection 9. These two positions are shown in FIGS. 6A and 6B where the carriage 20 is shown in front elevation.

Figure 6B:
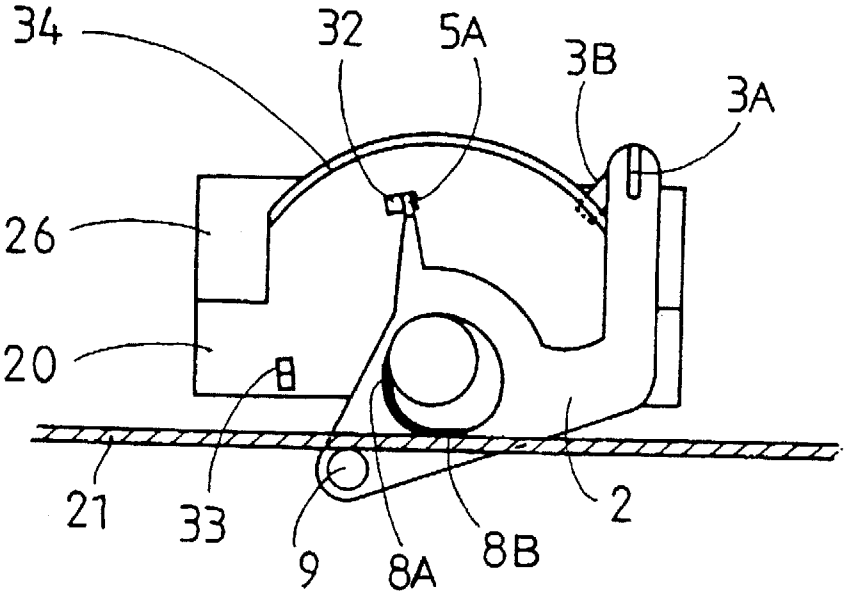
FIGS. 6A and 6B are front views showing a change in position of the carriage by rotation of the lever according to the first preferred embodiment.
Figure 6A:
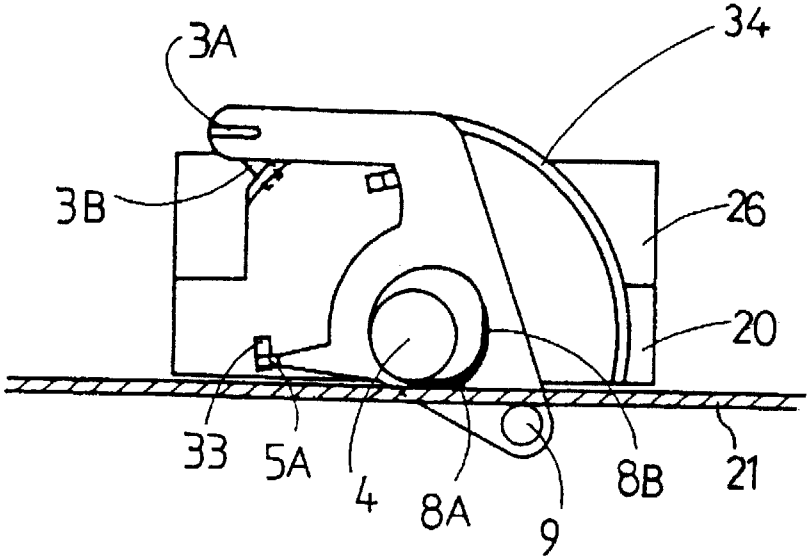

FIG. 6B shows the position obtained by clockwise rotating the lever 2. That is, when the lever 2 is clockwise rotated, the free end 5A of the stopper arm 5 first comes into contact with the stopper 32 and then passes over the stopper 32. Just after passing over the stopper 32, the free end 5A is stopped. At this time, the cam surface 8B of the eccentric cam 8 is in contact with the upper surface of the guide plate 21 and the projection is in contact with the lower surface of the guide plate 21. Thus, the guide plate 21 is sandwiched on its both surfaces by the cam surface 8B of the eccentric cam 8 and the projection 9. In this position, the cam surface 8B, to which the distance from the axis of the shaft portion 4 is larger, is in contact with the upper surface of the guide plate 21, so that the front portion of the carriage 20 is slightly lifted from the guide plate 21. That is, the front of carriage 20 is upward rotated about the guide shaft 24 provided at the rear end portion of the carriage 20. As a result, the print head 22, at the rear of the guide shaft 24 is displaced slightly forward to thereby adjust the head gap to the positions shown in FIG. 2. Further, since the projection 9 in this position is in contact with the lower surface of the guide plate 21, the lever 2 cannot be further rotated clockwise. Thus, as discussed, the position shown in FIG. 6B corresponds to the position shown in FIG. 2 which shows a side elevation of the carriage 20.

When the lever 2 is rotated counterclockwise from the above position by operating the knob 3A of the operation arm 3, the stopper arm 5 is elastically deformed to allow the free end 5A to pass over the stopper 32, resulting in cancellation of the sandwiched condition of the guide plate 21 between the cam surface 8B of the eccentric cam 8 and the projection 9. When the lever 2 is further rotated counterclockwise, the free end 5A first comes into contact with the stopper 33 and then passes over the stopper 33. Just after passing over the stopper 33, the free end 5A is stopped. This position is shown in FIG. 6A.

In this position, the cam surface 8A of the eccentric cam 8 is in contact with the upper surface of the guide plate 21 and the projection 9 is in contact with the lower surface of the guide plate 21. Thus, the guide plate 21 is sandwiched on its both surfaces by the cam surface 8A of the eccentric cam 8 and the projection 9. In this position, as the cam surface 8A, to which the distance from the axis of the shaft portion 4 is smaller, is in contact with the upper surface of the guide plate 21, the height of the front end portion of the carriage 20 above the guide plate 21 is slightly smaller than that in the position shown in FIG. 6B. Thus, the front of the carriage 20 is downward rotated about the guide shaft 24 provided at the rear end portion of the carriage 20. As a result, the print head 22 is displaced slightly backward to thereby adjust the head gap. Further, as the projection 9 in this position is in contact with the lower surface of the guide plate 21, the lever 2 cannot be further rotated counterclockwise. Although the side surface of the projection 9 is in contact with the lower surface of the guide plate 21 in both positions shown in FIGS. 6A and 6B, the contact position of the projection 9 in the position shown in FIG. 6A is different from that in the position shown in FIG. 6B.

Figure 3:
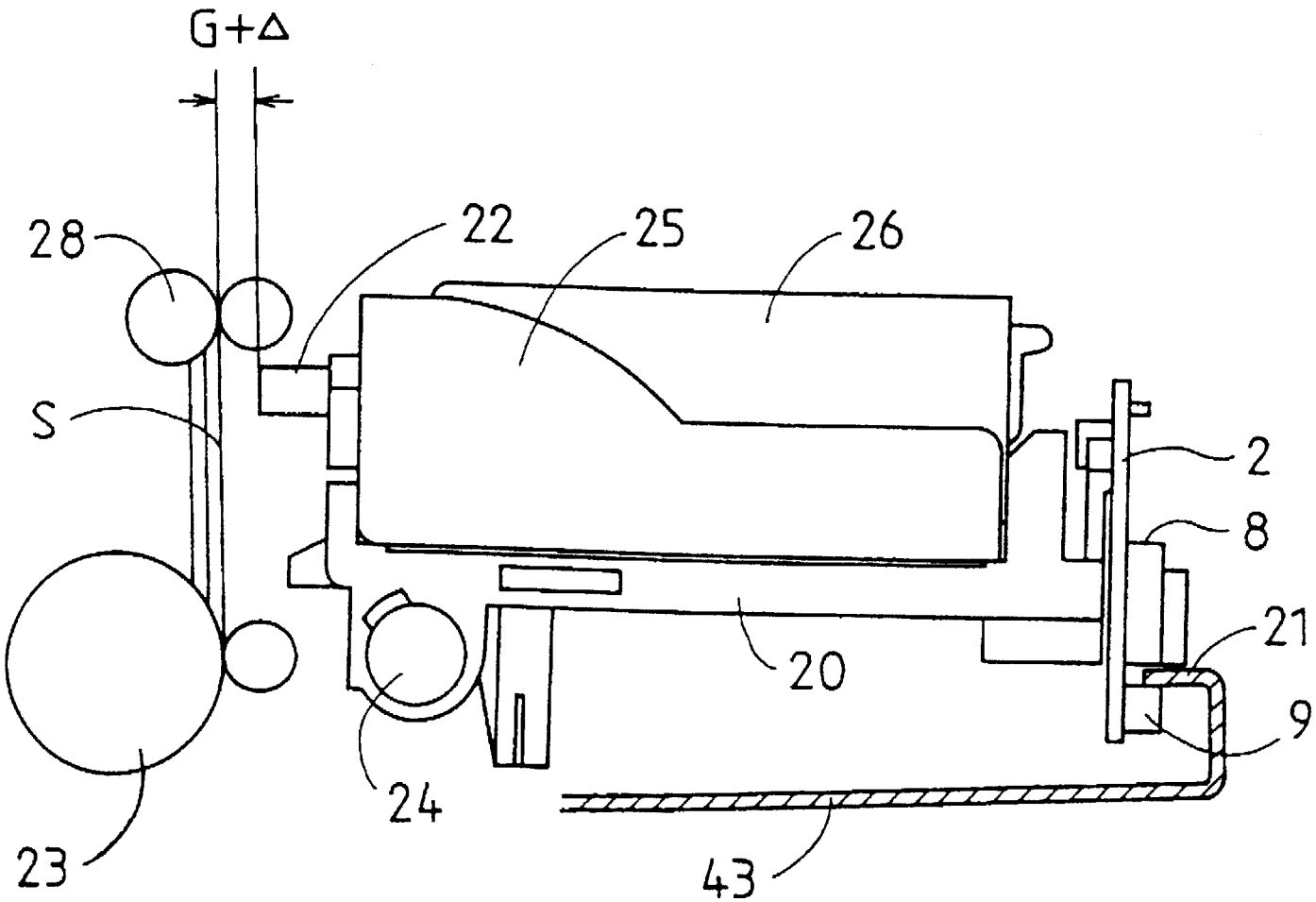
FIG. 3 is a side view illustrating a condition where the head gap adjusting mechanism in the printer has a second position corresponding to a thick sheet of printing paper.

The position shown in FIG. 6A corresponds to the position shown in FIG. 3 which is a side elevation of the carriage 20. As is apparent from FIG. 3, the carriage 20 is slightly rotated clockwise about the guide shaft 24 from the position shown in FIG. 2. Accordingly, the print head 22 is slightly retracted from the printing paper S by an amount Δ from the position shown in FIG. 2, thus obtaining a head gap G+Δ. In this manner, the head gap can be adjusted by rotating the lever 2 of the printer 1. That is, the head gap can be adjusted by manually operating the lever 2 according to the thickness of the printing paper S to be used. More specifically, when using a thin sheet of paper, such as standard paper as the printing paper S, printing is performed in the position shown in FIGS. 6B and 2, whereas when using a thick sheet of paper, such as an envelope or a postal card as the printing paper S, printing is performed in the position shown in FIGS. 6A and 3, whereby an increase in the thickness of the thick printing paper S can be canceled by the retraction amount Δ of the print head 2 to effect printing with an optimum head gap similar to the use of the standard printing paper S.

Figure 7:
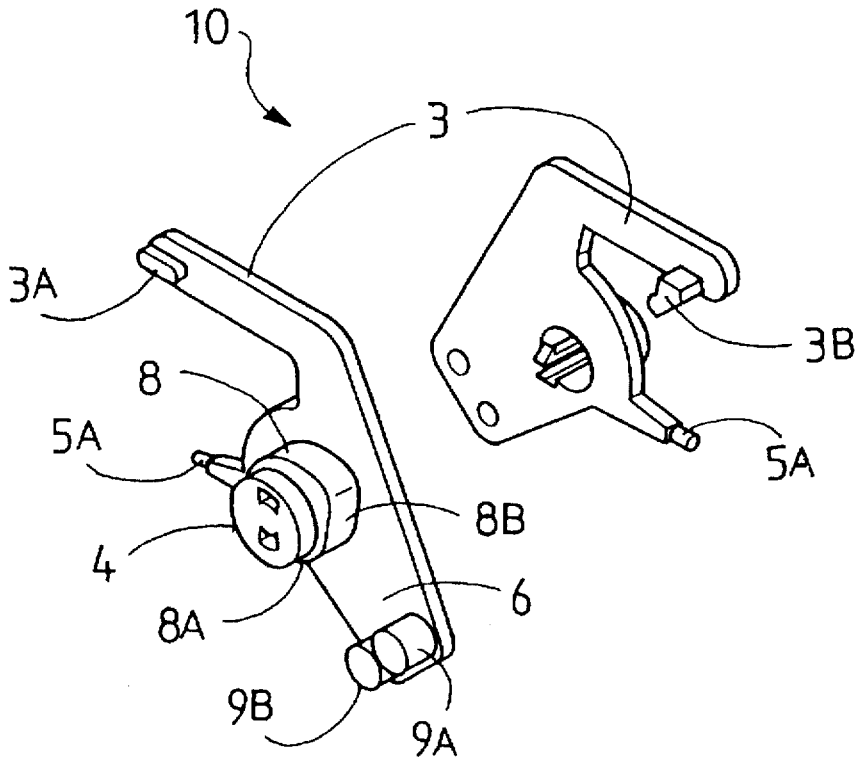
FIG. 7 is a perspective view of a lever according to a second preferred embodiment.

The second preferred embodiment of the invention will now be described with reference to FIGS. 7, 9A and 9B. In this preferred embodiment, the lever 2 used in the first preferred embodiment is replaced by a lever 10 different in shape from the lever 2. The parts are similar to those in the first preferred embodiment. As shown in FIG. 7, which is a perspective view of the lever 10 as viewed from its front side and its back side, the lever 10 is similar to the lever 2 in the point that the lever 10 is an integral member formed of a material having a low coefficient of friction, such as a synthetic resin, so as to have an operation arm 3, a shaft portion 4, a stopper arm 5, and a holding portion 6. The difference between the lever 2 and the lever 10 is that the holding portion 6 of the lever 10 is formed with two projections 9A,9B. There is no difference between the lever 2 and the lever 10 regarding the operation arm 3, the shaft portion 4, the eccentric cam 8, and the stopper arm 5. Like the lever 2, the lever 10 is rotatably mounted to the bearing portion 31 provided at the front end portion of the carriage 20.

The operation of the lever 10 will now be described. The rotation of the lever 10 about the axis of the shaft portion 4 allows selection of either the position where the guide plate 21 is sandwiched by the cam surface 8A of the eccentric cam 8 and the projection 9A or the position where the guide plate 21 is sandwiched by the cam surface 8B of the eccentric cam 8 and the projection 9B. These two positions are shown in FIGS. 9A and 9B where the carriage 20 is shown in front elevation.

Figure 9B:
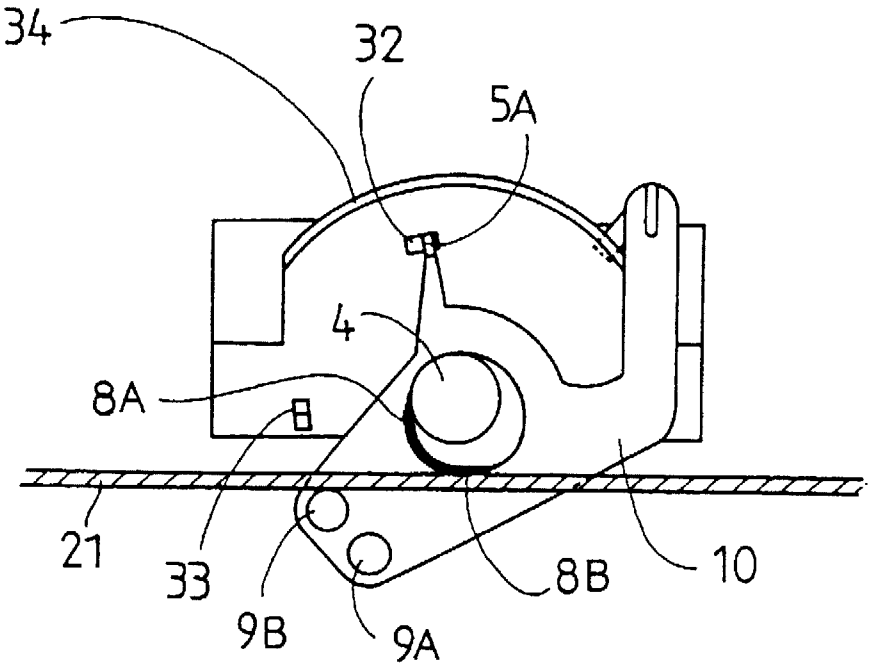
FIGS. 9A and 9B are front views showing a change in position of the carriage by rotation of the lever according to the second preferred embodiment.

FIG. 9B shows a position obtained by clockwise rotating the lever 10. That is, when the lever 10 is clockwise rotated, the free end 5A of the stopper arm 5 first comes into contact with the stopper 32 and then passes over the stopper 32. Just after passing over the stopper 32, the free end 5A is stopped. At this time, the cam surface 8B of the eccentric cam 8 is in contact with the upper surface of the guide plate 21 and the projection 9B is in contact with the lower surface of the guide plate 21. Thus, the guide plate 21 is sandwiched between the cam surface 8A of the eccentric cam 8 and the projection 9B. In this position, the cam surface 8B to which the distance from the axis of the shaft portion 4 is larger is in contact with the upper surface of the guide plate 21, so that the front portion of the carriage 20 is slightly lifted from the guide plate 21. Accordingly, the carriage 20 is upwardly rotated about the guide shaft 24 provided at the rear end portion of the carriage 20. As a result, the print head 22 is displaced forward to thereby adjust the head gap. Further, since the projection 9B in this position is in contact with the lower surface of the guide plate 21, the lever 2 cannot be further rotated clockwise. The position shown in FIG. 9B corresponds to the position shown in FIG. 2.

When the lever 10 is rotated counterclockwise from the above position, by operating the knob 3A of the operation arm 3, the stopper arm 5 is elastically deformed to allow the free end 5A to pass over the stopper 32, resulting in cancellation of the sandwiched condition of the guide plate 21 between the cam surface 8B of the eccentric cam 8 and the projection 9B. When the lever 10 is further rotated counterclockwise, the free end 5A first comes into contact with the stopper 33 and then passes over the stopper 33. Just after passing over the stopper 33, the free end 5A is stopped. This position is shown in FIG. 9A.

In this position, the cam surface 8A of the eccentric cam 8 is in contact with the upper surface of the guide plate 21, and the projection 9A is in contact with the lower surface of the guide plate 21. Thus, the guide plate 21 is sandwiched between the cam surface 8A of the eccentric cam 8 and the projection 9A. In this position, because the cam surface 8A to which the distance from the axis of the shaft portion 4 is smaller is in contact with the upper surface of the guide plate 21, the height of the front end portion of the carriage 20 from the guide plate 21 is slightly smaller than that in the position shown in FIG. 9B. Accordingly, the carriage 20 is downwardly rotated about the guide shaft 24 provided at the rear end portion of the carriage 20. As a result, the print head 22 is displaced backward to thereby adjust the head gap. Further, since the projection 9A in this position is in contact with the lower surface of the guide plate 21, the lever 2 cannot be further rotated counterclockwise.

Figure 9A:
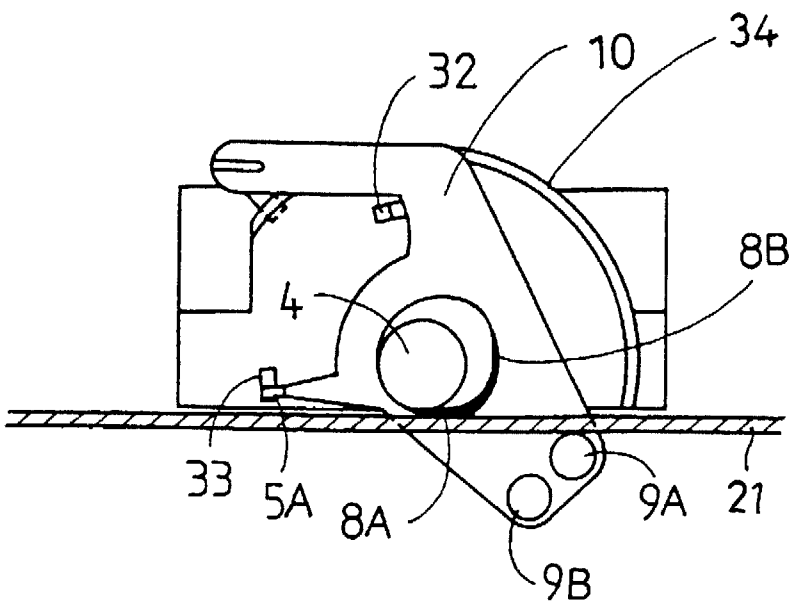

The position shown in FIG. 9A corresponds to the position shown in FIG. 3 showing a side elevation of the carriage 20. In this manner, as in the first preferred embodiment, the head gap can be adjusted by rotating the lever 10 according to the thickness of the printing paper S to be used. More specifically, when using a standard thickness sheet of paper as the printing paper S, printing is performed in the position shown in FIG. 9B, whereas when using a thick sheet of paper as the printing paper S, printing is performed in the position shown in FIG. 9A, whereby an increase in thickness of the thick printing paper S can be canceled by the retraction amount Δ of the print head 2 to effect printing with an optimum head gap in a manner similar to the case of using the standard printing paper S.

Figure 8:
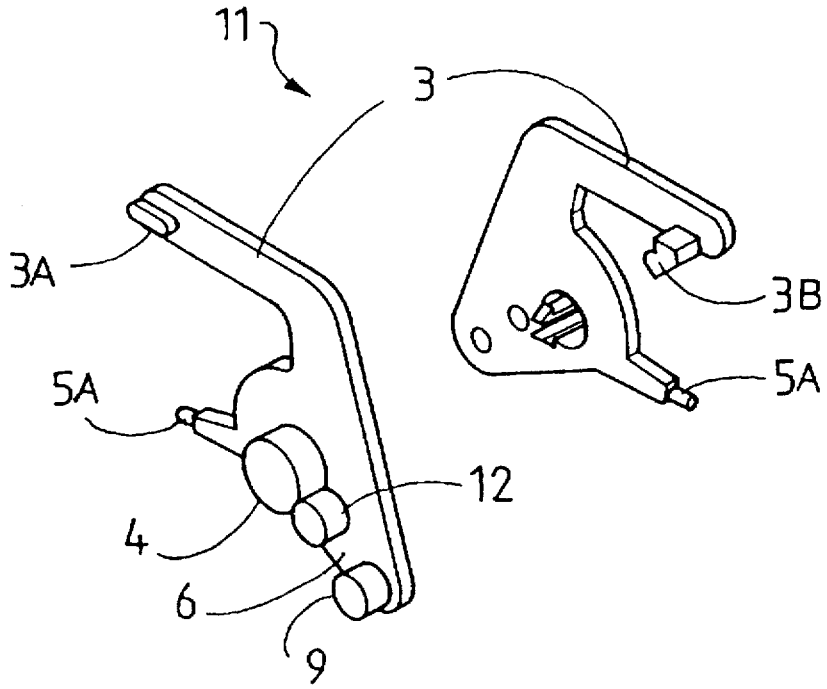
FIG. 8 is a perspective view of a lever according to the third preferred embodiment.

The third preferred embodiment of the invention will now be described with reference to FIGS. 8, 10A, and 10B. In this preferred embodiment, the lever 2 used in the first preferred embodiment is replaced by a lever 11 different in some parts from the lever 2 and other parts similar to those in the first preferred embodiment. As shown in FIG. 8, which is a perspective view of the lever 11 as viewed from its front side and its back side, the lever 11 is similar to the lever 2 in the point that the lever 11 is an integral member formed of a material having a low coefficient of friction, such as a synthetic resin, so as to have an operation arm 3, a shaft portion 4, a stopper arm 5, and a holding portion 6. The difference between the lever 2 and the lever 11 is that no eccentric cam is formed around the shaft portion 4 and a projection 12 is instead formed in the vicinity of the shaft portion 4. There is no difference between the lever 2 and the lever 11 regarding the operation arm 3, the holding portion 6, the projection 9, and the stopper arm 5. The center of the projection 12 does not lie on a line connecting the center of the shaft portion 4 and the center of the projection 9, but is slightly shifted to the operation arm 3 side. Like the lever 2, the lever 11 is rotatably mounted to the bearing portion 31 provided at the front end portion of the carriage 20.

The operation of the lever 11 will now be described. While the guide plate 21 is sandwiched by the projection 12 and the projection 9 by rotating the lever 11, the shift in the position of the projection 12 from the above line connecting the centers of the shaft portion 4 and the projection 9 allows selection of either a low position or a high position of the shaft portion 4 from the guide plate 21 in the sandwiched condition of the guide plate 21 obtained by rotating the lever 11 about the axis of the shaft portion 4. These two positions are shown in FIGS. 10A and 10B where the carriage 20 is shown in front elevation.

Figure 10B:
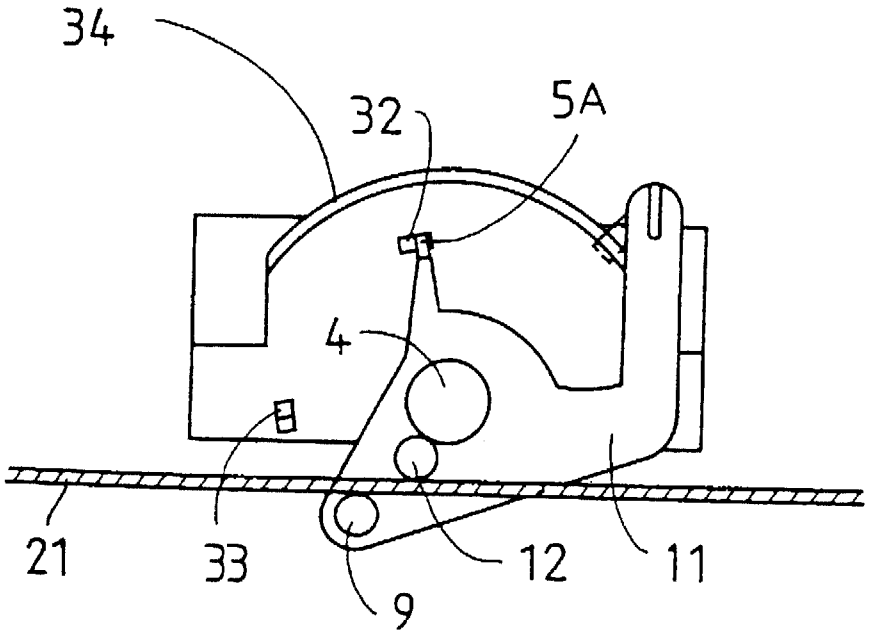
FIGS. 10A and 10B are front views showing a change in position of the carriage by rotation of the lever according to a third preferred embodiment.

FIG. 10B shows a position obtained by clockwise rotating the lever 11. That is, when the lever 11 is clockwise rotated, the free end 5A of the stopper arm 5 first comes into contact with the stopper 32 and then passes over the stopper 32. Just after passing over the stopper 32, the free end 5A is stopped. At this time, the projection 12 is in contact with the upper surface of the guide plate 21 and the projection 9 is in contact with the lower surface of the guide plate 21. Thus, the guide plate 21 is sandwiched between the projections 12,9. In this position, the front portion of the carriage 20 is slightly lifted from the guide plate 21. Accordingly, the carriage 20 is upwardly rotated about the guide shaft 24 provided at the rear end portion of the carriage 20. As a result, the print head 22 is displaced forward to thereby adjust the head gap. Further, since the projection 9 in this position is in contact with the lower surface of the guide plate 21, the lever 11 cannot be further rotated clockwise. This position shown in FIG. 10B corresponds to the position shown in FIG. 2 showing a side elevation of the carriage 20.

When the lever 11 is rotated counterclockwise from the above position by operating the knob 3A of the operation arm 3, the stopper arm 5 is elastically deformed to allow the free end 5A to pass over the stopper 32, resulting in cancellation of the sandwiched position of the guide plate 21 between the projections 12,9. When the lever 11 is further rotated counterclockwise, the free end 5A first comes into contact with the stopper 33 and then passes over the stopper 33. Just after passing over the stopper 33, the free end 5A is stopped. This position is shown in FIG. 10A.

In this position, the projection 12 is in contact with the upper surface of the guide plate 21 and the projection 9 is in contact with the lower surface of the guide plate 21. Thus, the guide plate 21 is sandwiched again between the projections 12,9. In this position, the height of the front end portion of the carriage 20 is slightly smaller than that in the position shown in FIG. 10B. Accordingly, the carriage 20 is downwardly rotated about the guide shaft 24 provided at the rear end portion of the carriage 20. As a result, the print head 22 is displaced backward to thereby adjust the head gap. Further, since the projection 9 in this condition is in contact with the lower surface of the guide plate 21, the lever 11 cannot be further rotated counterclockwise. Although a position on the side surface of the projection 9 is in contact with the lower surface of the guide plate 21 in both positions shown in FIGS. 10A and 10B, the contact position of the projection 9 in the position shown in FIG. 10A is different from that in the position shown in FIG. 10B. Similarly, while any one position on the side surface of the projection 12 is in contact with the upper surface of the guide plate 21 in both positions shown in FIGS. 10A and 10B respectively, the contact position of the projection 12 in the position shown in FIG. 10A is different from that in the position shown in FIG. 10B.

Figure 10A:
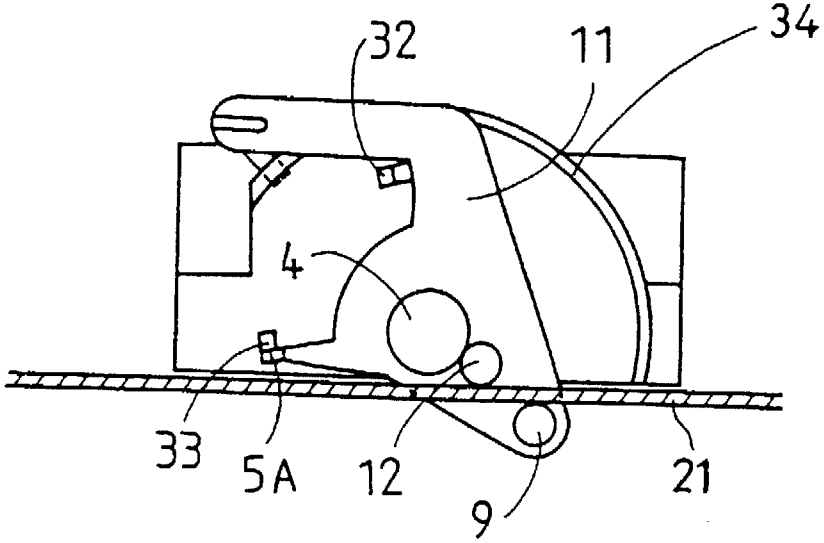
Figure 11B:
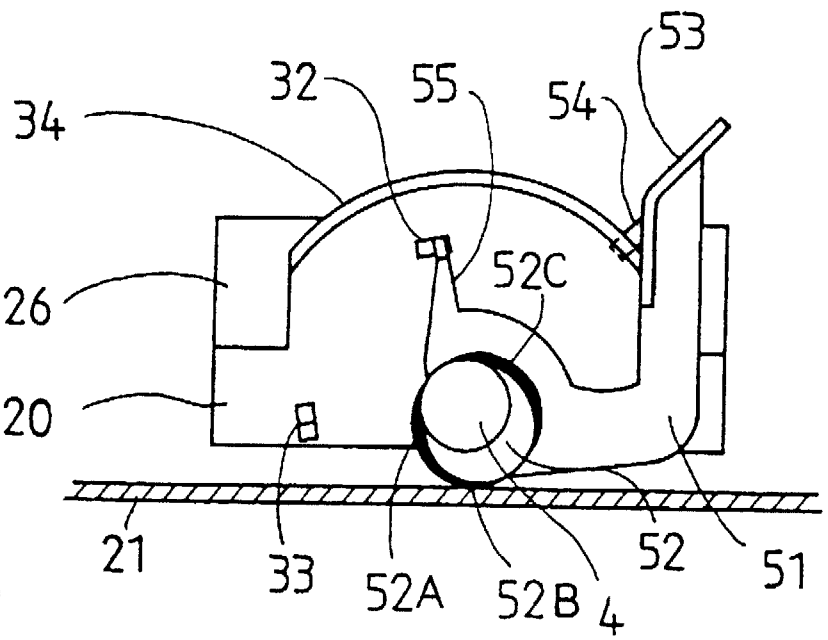
Fig.11B PRIOR ART
FIGS. 11A and 11B are front views showing a change in position of the carriage by rotation of the lever in the prior art printer.
Figure 11A:
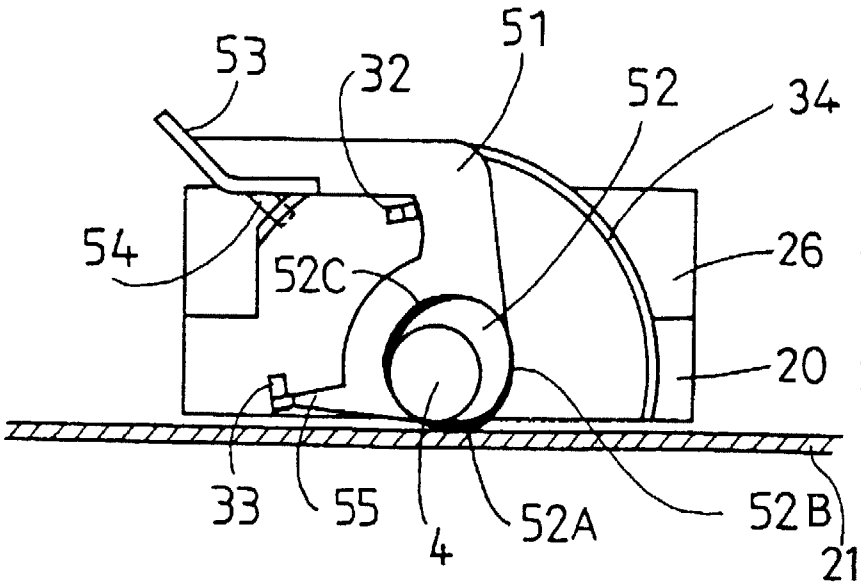
Fig.11A PRIOR ART

The position shown in FIG. 10A corresponds to the position shown in FIG. 3 showing a side elevation of the carriage 20. In this manner, as in the first and second preferred embodiments, the head gap can be adjusted by rotating the lever 11 according to the thickness of the printing paper S to be used. More specifically, when using a standard thickness sheet of paper as the printing paper S, printing is performed in the position shown in FIG. 10B, whereas when using a thick sheet of paper as the printing paper S, printing is performed in the position shown in FIG. 10A, whereby an increase in thickness of the thick printing paper S can be canceled by the retraction amount Δ of the print head 2 to effect printing with an optimum head gap similar to the case of using the standard printing paper S.

As described above in detail, in the printer 1 according to any one of the preferred embodiments mentioned above, any one of the levers 2,10,11 is rotatably mounted on the front end portion of the carriage 20 on which the print head 22 is mounted, and the front end portion of the carriage 20 is guided through the lever 2,10,11 along the guide plate 21. By rotating the lever 2,10,11, the height of the front end portion of the carriage 20 from the guide plate 21 is changed to thereby displace the print head 22 with respect to the printing paper S. Accordingly, an optimum head gap can be obtained in printing by operating the lever 2,10,11 according to the thickness of the printing paper S to be used.

In using the lever 2, the guide plate 21 is sandwiched by the cam surface 8B and the projection 9 in one lever position when using the standard thickness printing paper S, whereas the guide plate 21 is sandwiched by the cam surface 8A and the projection 9 in the other lever position when using thick printing paper S. Accordingly, in both lever positions, the carriage 20 is inhibited from rotating about the guide shaft 24 so that the optimum head gap can be maintained during printing to thereby prevent a deterioration in print resolution and frictional damage to the print head 22.

Furthermore, since the lever 2 is an integral member as one part, no additional biasing means is required thereby reducing the number of parts and the lever 2 can be easily mounted to the carriage 20.

In using the lever 10, the guide plate 21 is sandwiched by the cam surface 8B and the projection 9B in one lever position when using the standard thickness printing paper S, whereas the guide plate 21 is sandwiched by the cam surface 8A and the projection 9A in the other lever position when using thick printing paper S. Accordingly, the optimum head gap can be maintained with a reduced number of parts.

In using the lever 11, the guide plate 2 is sandwiched by the projection 12 and the projection 9 in both lever positions according to the standard thickness printing sheet S and the thick printing sheet S. Accordingly, the optimum head gap can be maintained with a reduced number of parts.

Further, in each preferred embodiment mentioned above, the guide plate 21 is sandwiched by the cam surface 8A,8B and the projection 9, by the cam surface 8A,8B and the projection 9A,9B, or by the projection 12 and the projection 9. Accordingly, even when an upward force is applied to the carriage 20, in performing the capping from the under side of the print head 22, undue separation of the eccentric cam 8 or the projection 12 from the guide plate 21 is prevented. Therefore, the capping for the print head 22 can always be performed reliably. As a result, the operation of covering the print head 22 with the purge cap 42 can be performed quickly.

It is to be noted that the invention is not limited to the above preferred embodiments, but various improvements and modifications may be made without departing from the scope of the invention. For example, although the print head 22 is mounted on the rear end surface of the carriage 20 in the above preferred embodiments, the print head 22 may be mounted on the lower surface of the carriage 20.

What is claimed is:

1. A head gap adjusting mechanism, comprising:

a carriage adapted to move along a print area;

a guide shaft for guiding one end of said carriage;

a guide plate for guiding the other end of said carriage; and a lever rotatably mounted on said carriage, wherein said lever is integrally formed with engagement means, said engagement means comprising:

a first upper contact portion and a second upper contact portion adapted to selectively come into contact with an upper surface of said guide plate by rotation of said lever;

a first lower contact portion adapted to come into contact with a lower surface of said guide plate when said first upper contact portion comes into contact with said upper surface of said guide plate; and a second lower contact portion adapted to come into contact with a lower surface of said guide plate when said second upper contact portion comes into contact with said upper surface of said guide plate, wherein a distance from the center of rotation of said lever to said first upper contact portion being different from a distance from the center of rotation of said lever to said second upper contact portion.

2. A printer with a head gap adjusting mechanism according to claim 1, wherein said lever has a first projecting portion and a second projecting portion, said first upper contact portion and said second upper contact portion are formed on a side surface of said first projecting portion, and said first lower contact portion and said second lower contact portion are formed on a side surface of said second projecting portion.

3. A printer with a head gap adjusting mechanism according to claim 1, wherein said lever has an eccentric cam portion and a projecting portion, said first upper contact portion and said second upper contact portion are formed on a side surface of said eccentric cam portion, and said first lower contact portion and said second lower contact portion are formed on a side surface of said projecting portion.

4. A printer with a head gap adjusting mechanism according to claim 1, wherein said lever has an eccentric cam portion, a first projecting portion, and a second projecting portion, said first upper contact portion and said second upper contact portion are formed on a side surface of said eccentric cam portion, said first lower contact portion is formed on a side surface of said first projecting portion, and said second lower contact portion is formed on a side surface of said second projecting portion.

5. A head gap adjusting mechanism for a printer, comprising:

a guide shaft;

a guide bar;

a carriage rotatably and slidably mounted at one side to the guide shaft and slidably mounted to the guide bar at an opposing side; and an adjusting lever rotatably mounted to the side of the carriage slidably mounted to the guide bar, the adjusting lever having engagement means for engaging a top and a bottom of the guide bar so as to change a height of the carriage relative to the guide bar between a first position and a second position, the engagement means comprising:

an upper contact portion having a first upper contact surface and a second upper contact surface selectively contacting the top of the guide bar upon rotation of the adjusting lever; and a lower contact member having a first lower contact surface and a second lower contact surface for selectively contacting the bottom of the guide bar upon rotation of the adjusting lever.

6. The head gap adjusting mechanism according to claim 5, further comprising:

a first projection extending from the opposing side of the carriage; and a second projection extending from the opposing side of the carriage, wherein the adjusting lever has an arm for engaging with a one of the first projection and the second projection to establish a head gap position.

7. The head gap adjusting mechanism according to claim 6, wherein the upper contact portion comprises an eccentric cam having a first cam surface as the first upper contact surface and a second cam surface as the second upper contact surface, the second cam surface at a greater distance from a center of rotation of the eccentric cam than the first cam surface, said eccentric cam riding on the top of the guide bar; and the lower contact member is a projection separated from the eccentric cam, the projection contacting, at the first lower contact surface and the second lower contact surface, the bottom of the guide bar when the adjusting lever is in one of the first position and the second position respectively.

8. The head gap adjusting mechanism according to claim 6, wherein the upper contact portion comprises an eccentric cam having a first cam surface as the first upper contact surface and a second cam surface as the second upper contact surface, the second cam surface at a greater distance from a center of rotation of the eccentric cam than the first cam surface, said eccentric cam riding on the top of the guide bar; and the lower contact member is a pair of projections separated from the eccentric cam, a different projection of the pair of projections contacting the bottom of the guide bar when the adjusting lever is in the first position and when the engagement means is in the second position.

9. The head gap adjusting mechanism according to claim 8, wherein a first projection of the pair of projections is the first lower contact surface and is in contact with the bottom of the guide bar when in the first position and a second projection of the pair of projections is the second lower contact surface and is in contact with the bottom of the guide bar when in the second position.

10. The head gap adjusting mechanism according to claim 6, wherein the upper contact portion comprises a first projection offset a short distance from an axis of rotation of the adjusting lever, the first projection riding on the top of the guide bar; and the lower contact portion comprises a second projection separate from the first projection, the second projection contacting the bottom of the guide bar when the adjusting lever is in one of the first position and the second position.

11. The head gap adjusting mechanism according to claim 10, wherein the second projection has a first lower contact surface in with the bottom of the guide bar when in the first position and a second lower contact surface in contact with the bottom of the guide bar when in the second position.

12. The head gap adjusting mechanism according to claim 10, wherein an axis of the first projection is above a line extending between the axis of rotation of the adjusting lever and an axis of the second projection.

13. The head gap adjusting mechanism according to claim 6, wherein the carriage rotates around the guide shaft when the adjusting lever is moved from the first position to the second position.

* * * * *